US006401583B1

(12) United States Patent
Kishine et al.

(10) Patent No.: US 6,401,583 B1
(45) Date of Patent: Jun. 11, 2002

(54) ARBITRARILY POSITIONED LATERAL PERFORATION FORMING APPARATUS FOR FORM PRINTING MACHINE

(75) Inventors: Toshiaki Kishine; Hideo Izawa; Mikio Yoshikawa, all of Chiba (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 09/377,171

(22) Filed: Aug. 19, 1999

(30) Foreign Application Priority Data

Aug. 24, 1998 (JP) ..... 10-237223

(51) Int. Cl.[7] ..... B26D 1/56

(52) U.S. Cl. ..... 83/295; 83/286; 83/311; 83/365; 83/371

(58) Field of Search ..... 83/286, 289, 295, 83/298, 303, 305, 311, 363, 365, 367, 368, 370, 371

(56) References Cited

U.S. PATENT DOCUMENTS

| | | | | | |
|---|---|---|---|---|---|
| 2,821,915 | A | * | 2/1958 | Katz | 83/305 |
| 2,994,783 | A | * | 8/1961 | Looschen | 83/365 |
| 3,283,636 | A | * | 11/1966 | Huck | 83/365 |
| 3,742,798 | A | * | 7/1973 | Gries | 83/298 |
| 3,839,974 | A | * | 10/1974 | Freres | 83/365 |
| 3,899,945 | A | * | 8/1975 | Garrett et al. | 83/38 |
| 3,921,428 | A | * | 11/1975 | Feres | 83/298 |
| 4,020,722 | A | * | 5/1977 | Byrt et al. | 83/74 |
| 4,095,084 | A | * | 6/1978 | Shutt | 83/365 |
| 4,201,102 | A | * | 5/1980 | Rudszinat | 83/298 |
| 4,202,229 | A | * | 5/1980 | Feldkamper | 83/311 |
| 4,267,752 | A | * | 5/1981 | Byrt et al. | 83/74 |
| 4,674,377 | A | * | 6/1987 | Groth | 83/324 |
| 4,737,904 | A | * | 4/1988 | Ominato | 83/365 |
| 4,781,317 | A | * | 11/1988 | Ditto | 226/27 |
| 4,955,265 | A | * | 9/1990 | Nakagawa et al. | 83/367 |

(List continued on next page.)

FOREIGN PATENT DOCUMENTS

| | | |
|---|---|---|
| JP | 2559036 | 9/1996 |
| JP | 9-76460 | 3/1997 |

*Primary Examiner*—M. Rachuba
*Assistant Examiner*—Kim Ngoc Tran
(74) *Attorney, Agent, or Firm*—Weneroth, Lind & Ponack, L.L.P.

(57) ABSTRACT

An arbitrarily positioned lateral perforation forming apparatus can form a lateral perforation at an arbitrary position or selected position in a continuous web paper at high precision by a simple control system with small control amount. A lateral roulette cylinder projecting a lateral roulette edge on its outer periphery, arranged on one side of the continuous web paper and rotating in a traveling direction of the continuous web paper; and a receptacle cylinder projecting an edge projecting portion opposing to the lateral roulette edge of the lateral roulette cylinder on its outer periphery, arranged on the other side of the continuous web paper, rotating in the traveling direction of the continuous web paper, and forming a lateral perforation in the continuous web paper when the edge receptacle portion opposes the roulette edge; are rotated in synchronism with traveling of the continuous web paper in the drive system. Furthermore, the arbitrarily positioned lateral-perforation forming apparatus includes a first differential mechanism disposed in an element connected to one of the lateral roulette cylinder and the receptacle cylinder in the drive system, causing difference in rotational phases of the lateral roulette cylinder and the receptacle cylinder by varying rotation of a differential shaft thereof for selectively placing the edge receptacle portion at a position opposing to the roulette edge and a position circumferentially offsetting from the roulette edge, and a first control unit for controlling rotation of the differential shaft of the first differential mechanism.

6 Claims, 9 Drawing Sheets

U.S. PATENT DOCUMENTS 5,083,487 A * 1/1992 Croteau ..... 83/370
5,461,450 A * 10/1995 Long et al. ..... 83/365
5,768,959 A * 6/1998 Lorenzo ..... 83/367
5,797,305 A * 8/1998 Harrod et al. ..... 83/37
5,839,688 A * 11/1998 Hertel et al. ..... 242/523.1
5,899,128 A * 5/1999 Smithe et al. ..... 83/76

* cited by examiner

ARBITRARILY POSITIONED LATERAL PERFORATION FORMING APPARATUS FOR FORM PRINTING MACHINE

BACKGROUND OF THE INVENTION

1. Field of the Invention

The present invention relates generally to a lateral perforation forming apparatus for a form printing machine. More particularly, the invention relates to an arbitrarily positioned lateral perforation forming apparatus for forming a lateral perforation at an arbitrary position or a selected position in a continuous web paper printed by a form printing machine, depending upon a printed image.

2. Description of the Related Art

Since a form printing machine performs a printing by means of a plate cylinder having a predetermined peripheral length, printing on a continuous web paper repeatedly makes a print per predetermined length in a feeding direction of the continuous web paper, namely makes repeated prints of the same image. Then, when a lateral or cross line perforation aligned in a perpendicular direction to a longitudinal direction of the continuous web paper is formed in a part of the printed image of such repeated prints of the same image, it is typical to perform a formation of the perforation by means of a perforation forming cylinder or a roulette cylinder having the same peripheral length as the plate cylinder in a similar manner to printing. In such conventional apparatus, the perforation formation is inherently performed sequentially and repeatedly for all printed images. Therefore, it has not been possible to form the lateral perforation only for preliminarily selected image.

In addition to the above-mentioned typical prior art, there has been known the conventional lateral perforation forming apparatus which can form a perforation to preliminarily selected printed image. Such perforation forming apparatus have been disclosed in Japanese Patent No. 2559036 and Japanese Unexamined Patent Publication (Kokai) No. Heisei 9-76460.

The former apparatus as disclosed in Japanese Patent No. 2559036 includes a rotary body driving source separately from a paper drive mechanism for feeding a continuous web paper. The disclosed apparatus further comprises a rotary body having a plurality of perforation forming portions performing a formation of lateral perforation in the continuous web paper and inactive portions located between the perforation forming portions and not contacting with the continuous web paper, a perforation forming pattern input portion for inputting a perforation forming pattern to be formed by the perforation forming portion of the rotary body, a detector for detecting a feed position and a feed speed of the continuous web paper fed by the paper drive mechanism, and a control unit, in response to a continuous web paper feed amount signal generated by the detector, adjusting a rotation speed of the rotary body to the same speed as the paper feeding speed when each perforation forming portion of the rotary body performs the formation of perforation for the continuous web paper, and electrically controlling the driving source of the rotary body to adjustably increase and decrease a rotation speed of the rotary body relative to the feed speed of the continuous web paper upon non-forming of perforation where each inactive portion of the rotary body is placed in opposition to a feeding path of the continuous web paper, and whereby adjusting interval of a plurality of perforation forming position of the continuous web paper.

On the other hand, the latter apparatus as disclosed in Japanese Unexamined Patent Application No. Heisei 9-76460 is originally adapted for cutting the continuous web paper at predetermined positions. However, the apparatus is also applicable to a formation of the lateral perforation. The apparatus comprises a cutting cylinder (roulette cylinder), which is disposed on an upstream side of an oscillatory shooter assembly in a web paper traveling path. The cutting cylinder includes a full edge type cutting member (lateral roulette edge) which is protruded from a peripheral surface of the cutting cylinder and which forms the cross line of cuts (lateral perforation) interposed by at least one small uncut portion in the continuous web paper. The cutting cylinder is synchronously rotated with the feeding speed of the continuous web paper for forming the cross line of cuts (lateral perforation) in response to a signal detecting the predetermined feeding length of said continuous web paper. In the construction set forth above, bearing boxes supporting both ends of the cutting cylinder are supported on frames for eccentric rotation relative to a center of the cutting cylinder so that the cutting cylinder is moved toward and away from an impression cylinder (receptacle cylinder) according to eccentric rotation of the bearing box for forming the cross line of cuts (forming lateral perforation) in the continuous web paper upon contacting of the cutting cylinder with the impression cylinder.

The former prior art is so-called a single motor type lateral perforation forming apparatus and encounters the following problem.

The disclosed apparatus performs the formation of lateral perforation by driving a stand-alone lateral perforation forming motor provided independently of the motor for paper feeding, in synchronism with a signal from the control unit. However, due to an inertia load of the lateral roulette cylinder and an impact upon the formation of perforation, the rotation and perforation formation may be performed in a condition where the position of the roulette edge is dislocated from the position synchronized with the signal to cause an error in the perforation forming position in the product.

The foregoing phenomenon becomes more significant at higher speed operation where the inertia load of the lateral roulette cylinder becomes greater. For this reason, in order to facilitate an accurate control of rotation of the lateral roulette cylinder in high speed range, the lateral roulette cylinder having small diameter, e.g. about 80 mm in diameter, inducing smaller inertia load, is employed. However, it causes a problem that the lateral perforation is not formed for a deflecting deformation of the lateral roulette cylinder. In addition, the rotation of the lateral roulette cylinder has to be accurately synchronized with flow of the continuous web paper. Since the rotating drive source is the single motor, a large servo motor (pulse motor) having high torque becomes necessary. Then, a drive control portion for the servo motor having large capacity has to be used to perform the accurate synchronization, to result in high cost.

On the other hand, the latter prior art does not require the roulette position control depending upon motor control which encounters the drawback in the former prior art, but can form perforation at accurate position in mechanical synchronous operation. However, the latter prior art encounters the following problem.

Namely, since the bearing box supporting the lateral roulette cylinder rotates eccentrically relative to the center of the lateral roulette cylinder at every time of formation of lateral perforation, a play should be caused by wearing in a rotary support of the frame rotatably supporting the bearing box through repeated rotating operation, to result in an accident that the lateral perforation is not formed. On the other hand, accurate fitting between the bearing box and the frame is difficult to establish, both the components should be finished for avoiding play, and thermal expansion can be caused in the fitting portion to make the bearing box to difficult to rotate for frequent rotation of the bearing box, to require a large capacity driving source, such as a liquid pressure cylinder, for driving the bearing box to rotate overcoming the resistance increased due to thermal expansion. If the driving source becomes large, response characteristics to a control command is degraded to cause a failure in movement of the roulette cylinder toward and away from the receptacle cylinder.

Therefore, an anti-friction bearing, such as needle bearing, may be used in rotating support portion of the bearing box in the frame. However, cost becomes high. Furthermore, since such anti-friction bearing is not durable against impact load and vibration load to cause play and damage at early timing in the anti-friction bearing.

SUMMARY OF THE INVENTION

The present invention has been worked out in view of the drawbacks in the prior art set forth above. Therefore, it is an object of the present invention to provide an arbitrarily positioned lateral perforation forming apparatus which can form lateral perforation in an arbitrary position or a selected position of a continuous web paper with small control amount to permit simplification of a control system, and can accurately form lateral perforation at the arbitrary position or the selected position.

In order to accomplish the above-mentioned objects, a arbitrarily positioned lateral perforation forming apparatus, according to the present invention, comprises:

a lateral roulette cylinder projecting a lateral roulette edge on its outer periphery, arranged on one side of a continuous web paper, and rotating in a traveling direction of the continuous web paper;

a receptacle cylinder projecting an edge receptacle portion opposing to the lateral roulette edge of the lateral roulette cylinder, on its outer periphery, arranged on the other side of the continuous web paper, rotating in the traveling direction of the continuous web paper, and forming a lateral perforation in the continuous web paper when the edge receptacle portion is in opposition to the roulette edge;

a drive system for rotating the lateral roulette cylinder and the receptacle cylinder in synchronism with traveling of the continuous web paper;

a first differential mechanism disposed in an element connected to one of the lateral roulette cylinder and the receptacle cylinder in the drive system, causing difference in rotational phases of the lateral roulette cylinder and the receptacle cylinder by varying rotation of a differential shaft thereof for selectively placing the edge receptacle portion at a position opposing to the roulette edge and a position circumferentially offsetting from the roulette edge; and a first control unit for controlling rotation of the differential shaft of the first differential mechanism.

In addition to the foregoing construction, it is preferred that the arbitrarily positioned lateral perforation forming apparatus further comprises a second differential mechanism disposed in an element commonly connected to the lateral roulette cylinder and the receptacle cylinder in the drive system, and varying a position to be formed with the lateral perforation in the continuous web paper by making rotations of the lateral roulette cylinder and the receptacle cylinder synchronous with traveling of the continuous web paper by varying rotation of a differential shaft thereof; and.

a second control unit for controlling rotation of the differential shaft of the second differential mechanism.

In addition to the foregoing construction, it is preferred that the arbitrarily positioned lateral perforation forming apparatus further comprises:

a mark sensor reading a mark printed on the continuous web paper and inputting a mark read signal to the first control unit, the first control unit is responsive to the mark read signal for driving the first differential mechanism to perform a formation of lateral perforation.

Furthermore, the first differential mechanism may be disposed in the element connected to the receptacle cylinder of the drive system or in the element connected to the roulette cylinder in the drive system.

With the construction set forth above, the lateral roulette cylinder and the receptacle cylinder are driven to rotate along the traveling direction of the continuous web paper by the drive system. Then, at this time, by rotating the differential shaft of the first differential mechanism, the rotational phase of one of the lateral roulette cylinder and the receptacle cylinder is shifted relative to the rotational phase of the other.

By causing difference in the rotational phases, when the lateral roulette edge of the lateral roulette cylinder is placed in opposition to the edge receptacle portion projecting on the receptacle cylinder, the lateral perforation can be formed in the continuous web paper traveling therebetween. The formation of the lateral perforation can be arbitrarily performed by controlling the first differential mechanism via the first control unit. Furthermore, by only shifting the rotational phase of one of the lateral roulette cylinder and the receptacle cylinder relative to the rotational phase of the other, one of the cylinders can be selectively placed at the active position where the lateral perforation is formed and inactive position where the lateral perforation is not formed. Thus, the lateral perforation can be arbitrarily formed with small control amount. Accordingly, the control system can be simplified, and the lateral perforation can be formed at arbitrary position with high precision.

Also, by rotation the differential shaft of the second differential mechanism via the second control unit, rotation of the lateral roulette cylinder and the receptacle cylinder can be synchronous with traveling of the continuous web paper. By this, the position to be formed with the lateral perforation can be arbitrarily varied in the longitudinal direction (traveling direction) of the continuous web paper.

Further, the actuation of the first differential mechanism is performed by reading the mark by the mark sensor and on the basis of the read signal. By this, only on the portion of the continuous web paper where the mark is printed, the lateral perforation can be formed. For example, the lateral perforation can be formed at a predetermined position of a sheet with the mark which is preliminarily printed on the continuous web paper. By this the lateral perforation can be selectively formed at the portion of the preliminarily selected image.

The present invention will be understood more fully from the detailed description given herebelow and from the accompanying drawings of the preferred embodiment of the present invention, which, however, should not be taken to be limitative to the invention, but are for explanation and understanding only.

DESCRIPTION OF THE PREFERRED EMBODIMENT

The present invention will be discussed hereinafter in detail in terms of the preferred embodiment of the present invention with reference to the accompanying drawings, i.e. FIGS. 1 to 10. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
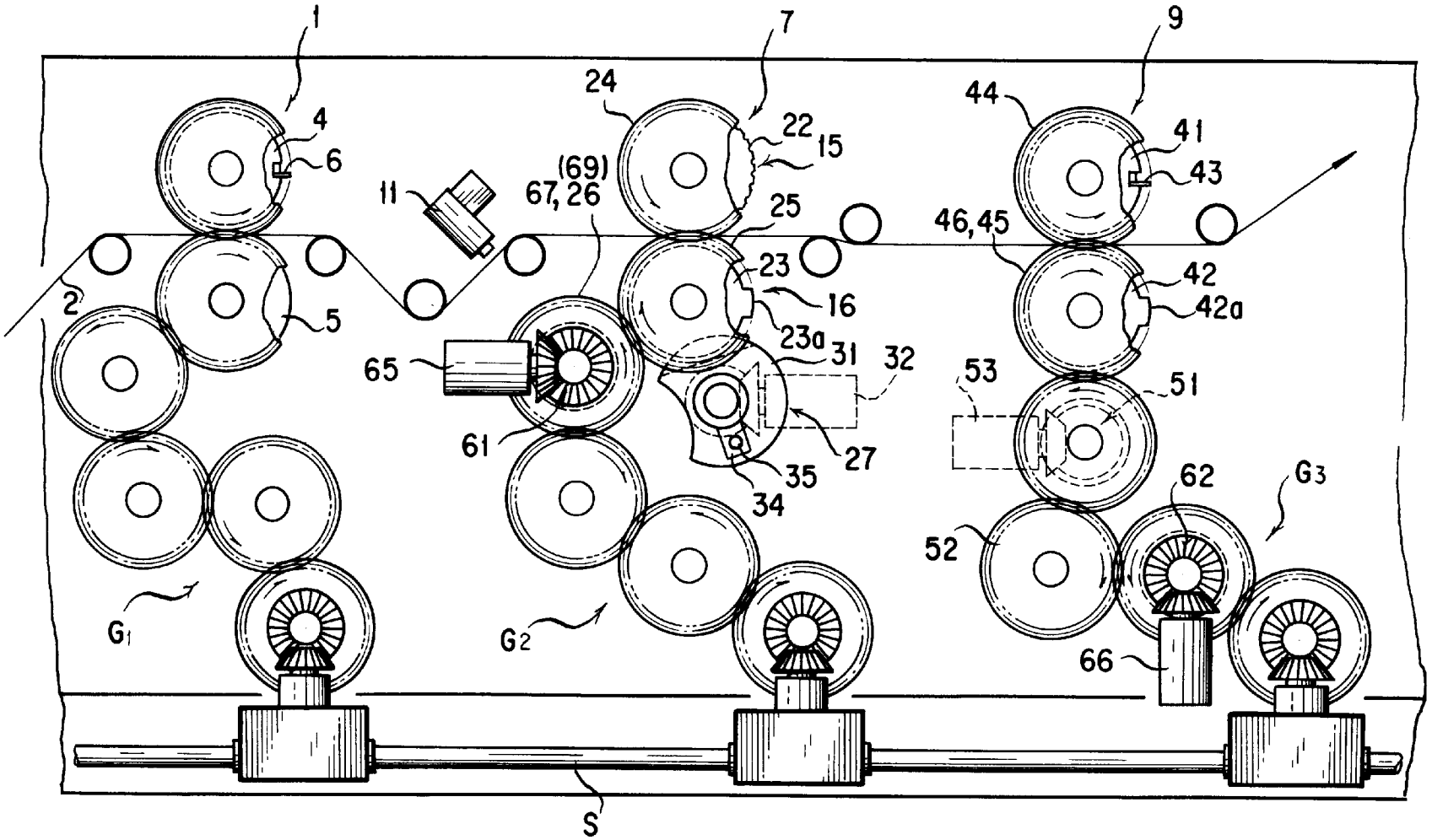
FIG. 1 is an explanatory illustration showing a general construction of a perforation forming section of a form printing machine including one embodiment of an arbitrarily positioned lateral perforation forming apparatus according to the present invention.
Figure 2:
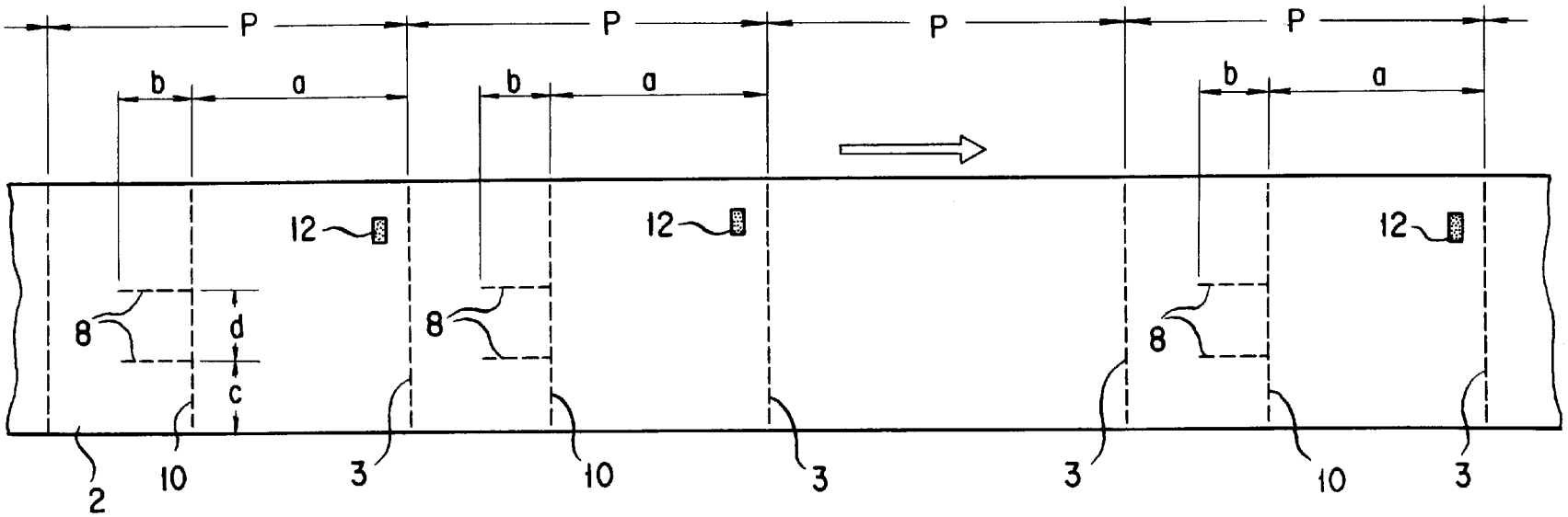
FIG. 2 is a plan view of one example of a continuous web paper to be formed perforation by the perforation forming section.

In the drawings, the reference numeral 1 denotes a fold line lateral perforation forming apparatus for forming a lateral perforation 3 for a fold line in a continuous web paper 2 which is fed sequentially, at predetermined interval as shown in FIG. 2. The lateral perforation forming apparatus has a construction well known in the art and comprises a fold line lateral roulette cylinder 4 and a receptacle cylinder 5 rotating in synchronism with a traveling speed of the continuous web paper 2. The lateral perforation 3 for the fold line is formed per a given interval P in the continuous web paper 2 by means of a lateral roulette edge 6 fixed on the fold line lateral roulette cylinder 4 by cooperated rotations of both cylinders 4 and 5. Then, the lateral perforation forming apparatus 1 for the fold line is connected to a drive shaft S of a machine via a drive gear train (drive system) G1.

In the drawings, the reference numeral 7 denotes an arbitrarily positioned longitudinal perforation forming apparatus which is located downstream the lateral perforation forming apparatus 1 for the fold line in a traveling direction of the continuous web paper 2 and forms a longitudinal or in-line perforation 8 aligned in the longitudinal direction of the continuous web paper, at an arbitrary position in the continuous web paper 2 along a traveling direction thereof.

On the other hand, in the drawing, the reference numeral 9 denotes an arbitrarily positioned lateral perforation forming apparatus which located downstream the arbitrarily positioned longitudinal perforation forming apparatus 7 and forms a lateral perforation 10 at an arbitrary position in the continuous web paper 2 along the traveling direction thereof.

Then, in the drawings, the reference numeral 11 denotes a mark sensor for reading a mark 12 preliminarily set by printing on the continuous web paper 2. The mark sensor 11 is provided on upstream side of the arbitrarily positioned longitudinal perforation forming apparatus 7.

Next, the construction and function of the arbitrarily positioned longitudinal perforation forming apparatus will be discussed with reference to FIGS. 1 and 3 to 5. In the drawings, the reference numerals 15 and 16 are respectively a longitudinal roulette cylinder and a receptacle cylinder located in opposition across a traveling path of the continuous web paper 2.

A longitudinal roulette cylinder 15 is constructed with a first rotary shaft 19 supported on frames 17 and 18 on both sides and a disc-shaped longitudinal roulette edge 20 fixed on the first rotary shaft 19 as positioned in an axial direction and provided roulette edge on its outer periphery. A plurality of, for example two the longitudinal roulette edges 20 are provided with a predetermined interval d. Then, the longitudinal roulettes 20 are fixed by fastening screws 21. By loosening the fastening screws 21, the longitudinal roulettes 20 are movable in the axial direction. The longitudinal roulette 20 is locked on the first rotary shaft 19 in a rotating direction by means of a key 19*b*.

The receptacle cylinder 16 is constructed with a second rotary shaft 22 supported on frames 17 and 18 on both sides and a disc-shaped edge receptacle portion 23 engaged with the second rotary shaft 22 slidably in axial direction and provided with edge receptacle portion 23*a* of projective step shape which contacts with (or is placed in opposition to across a fine gap) the longitudinal roulette edge 20 of the longitudinal roulette cylinder 15. A plurality of the edge receptacle plates 23 of which number corresponds to number of the longitudinal roulette edge 20 (i.e. two) are engaged with the second rotary shaft 22. On the other hand, a length in the circumferential direction of the edge receptacle portion 23*a* of the edge receptacle plate 23 corresponds to a length b of the longitudinal perforation 8 shown in FIG. 2. The edge receptacle plate 23 is locked on the second rotary shaft 22 in the rotating direction by means of a key 22*b*.

The first and second rotary shafts 19 and 22 are extended outwardly from one frame 17. On the extended portions of the first and second rotary shafts 19 and 22, mutually meshing gears 24 and 25 are integrally engaged, respectively, to rotate in mutually opposite directions. One gear 25 is meshed with an input gear 26 of a drive gear train G2 for forming the longitudinal perforation, and the drive gear train G2 is connected to the drive shaft S of the apparatus.

The reference numeral 27 denotes an edge receptacle plate moving device for moving the edge receptacle plate 23 in axial direction. The edge receptacle plate moving device 27 is constructed with a threaded shaft 29 rotatably supported on the frames 17 and 18 on both sides and having feeding thread 28 on the outer periphery, a sleeve 30 threadingly engaged with the feeding thread 28 of the threaded shaft 29 and a shifting member 31 engaged with the sleeve 30 movably in the axial direction. To the threaded shaft 29, a servo motor 32 is connected. It should be noted that, in certain construction of the servo motor 32, a speed reduction gear unit, such as a harmonic drive (tradename) which will be discussed later and can obtain a large reduction ratio, may be interposed between the servo motor 32 and the threaded shaft 29.

The shifting members 31, number of which corresponds to number of the edge receptacle plates 23, are engaged with the sleeves 30 with an interval d the same as the interval of the edge receptacle plates 23, and is fixed to the sleeve by the fastening screws 33. The shifting members 31 are movable in the axial direction by loosening the fastening screws 33. To the sleeve 30, an arm 34 is projected in a direction perpendicular to the axial direction. To the arm 34, a rotation stopper shaft 35 projected on one frame 17 in the axial direction is engaged slidably in the axial direction.

Figure 3:
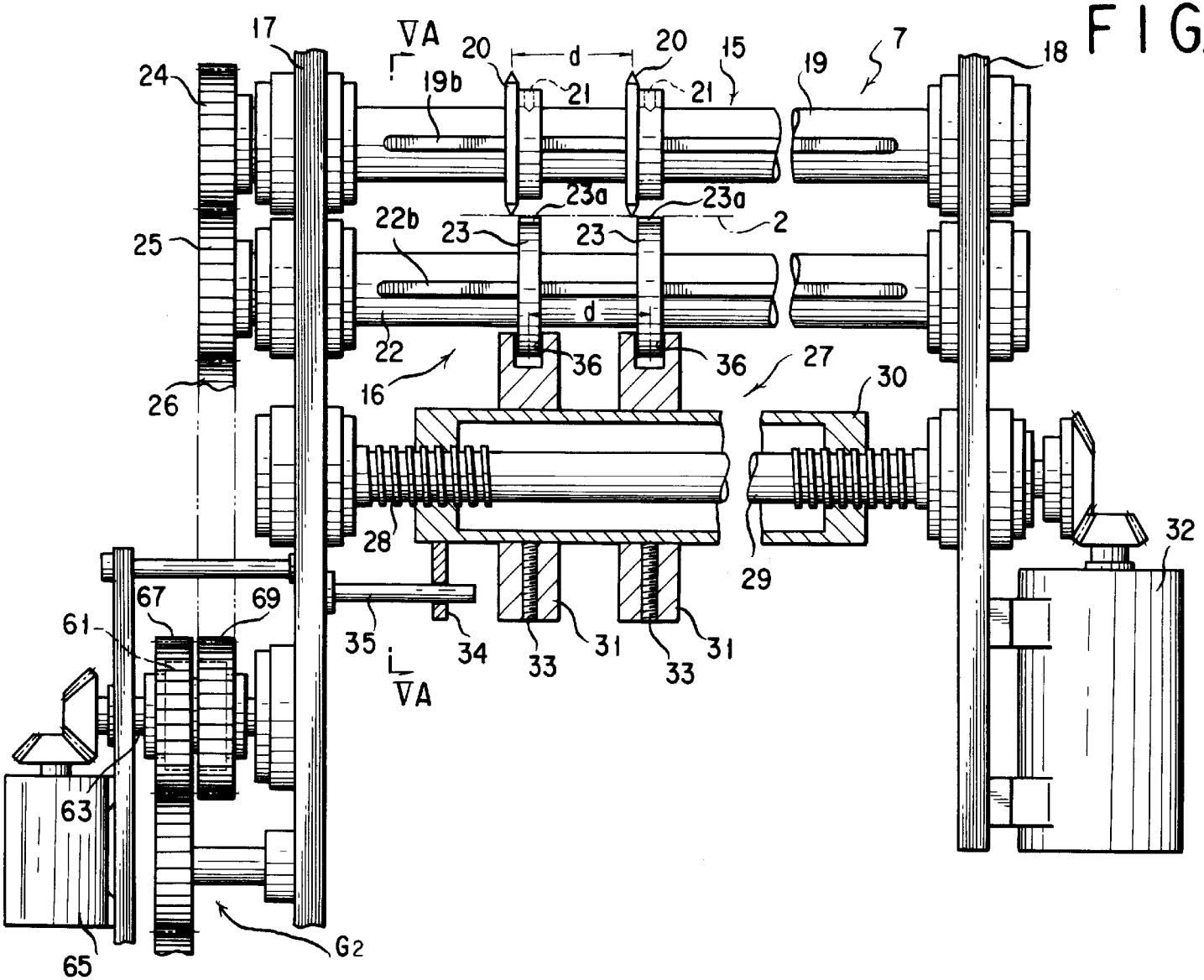
FIG. 3 is an explanatory illustration showing one example of the arbitrarily positioned longitudinal perforation forming apparatus in the perforation forming section.
Figure 5B:
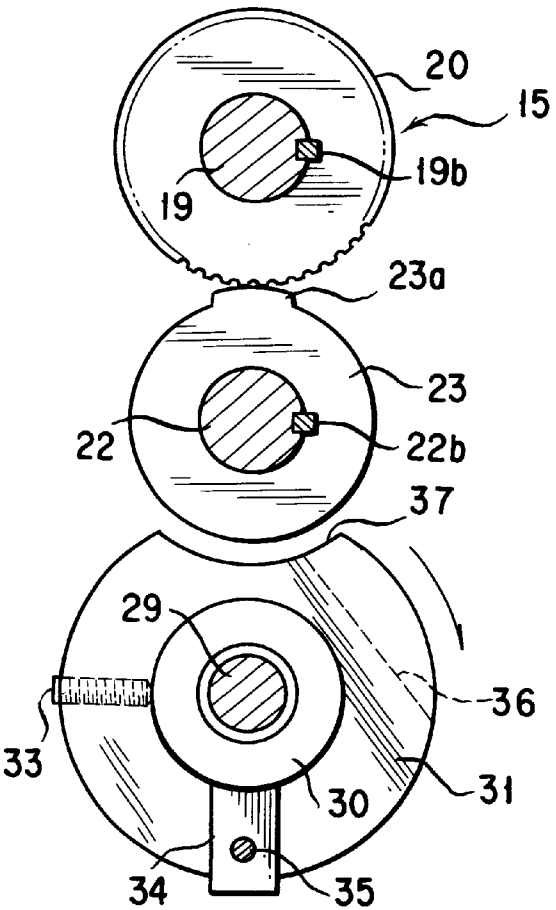
FIG. 5B is a section showing a condition where a shifting member is rotated in FIG. 5A.
Figure 5A:
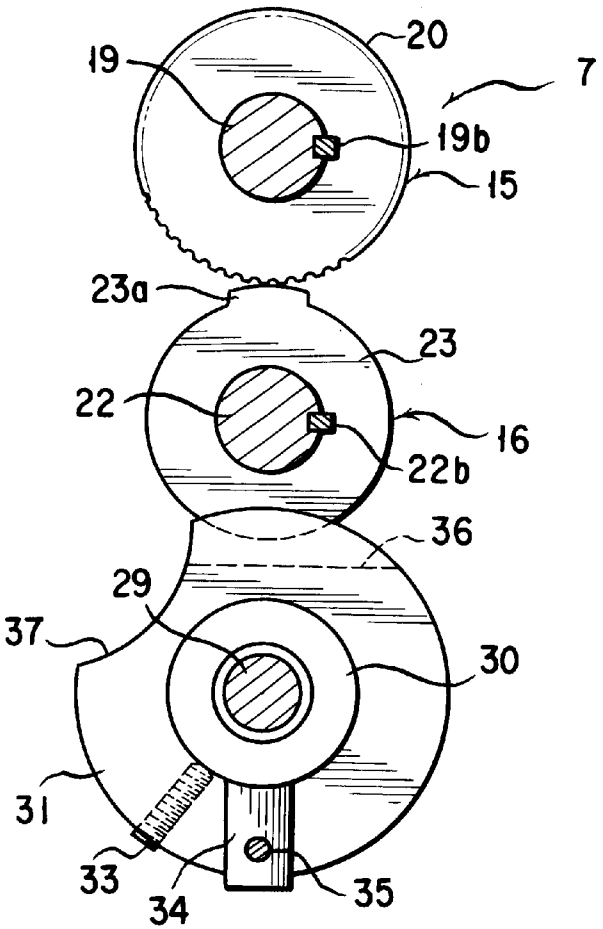
FIG. 5A is a section taken along line VA—VA of FIG. 3.

As shown in FIGS. 3, 5A and 5B, the shifting members 31 are provided with grooves 36 on parts of the peripheral edge portions, respectively. The grooves 36 are engaged with peripheral edge portions of the edge receptacle plates 23 so that the edge receptacle plates 23 are moved in the axial direction along the second rotary shaft 22 by axial movement of the shifting members 31. On the peripheral edge portions of the shifting members 31, cut-outs 37 is provided at a portion adjacent to the groove 36 in the circumferential direction, without causing interference with the edge receptacle plates 23 in the axial direction, respectively. By rotating the shifting members 31 about the sleeve 30 as shown in FIG. 5B and thus placing the cut-outs 37 in opposition to the peripheral surface of the edge receptacle plates 23, engagements between the edge receptacle plates 23 and the shifting members 31 are released, respectively.

In the arbitrarily positioned longitudinal perforation forming apparatus 7, the gears 24 and 25 are driven in mutually opposite directions by rotation of the input shaft 26 of the drive gear train G2 for formation of the longitudinal perforation, for rotatingly driving the longitudinal roulette cylinder 15 and the receptacle cylinder 16 to rotate at a peripheral speed at which the longitudinal roulette edges 20 and the edge receptacle plates 23 respectively match with the feeding speed of the continuous web paper 2.

The edge receptacle plate 23 is normally offset in axial direction relative to the longitudinal roulette edge 20. The threaded shaft 29 of the edge receptacle plate moving device 27 is driven to rotate by the servo motor 32 to move the sleeve 30 in the axial direction. By the shifting members 31 integrally moving with the sleeve 30 , the edge receptacle plates 23 are moved in the axial direction. Then, when the edge receptacle plates 23 are placed in opposition with the longitudinal roulette edges 20, the longitudinal perforation 8 is formed in the continuous web paper 2 over a length corresponding to the length of the edge receptacle portion 23*a* of the edge receptacle plate 23. Thereafter, when the edge receptacle plate moving device 27 is operated in the opposite direction by revolution of the servo motor 32 in reverse direction, the edge receptacle plates 23 are offset in the axial direction relative to the longitudinal roulette edges 20 so as not to form the longitudinal perforation 8.

The positions and interval of forming the longitudinal perforations 8 are determined by positions of the longitudinal roulette edges 20 and the edge receptacle plated 23 corresponding thereto. On the other hand, number of longitudinal perforations 8 can be arbitrarily determined by number of pairs of the longitudinal roulette edges 20 and the edge receptacle plates 23. Also, by placing some of a plurality of pairs of the longitudinal roulette edges 20 and the edge receptacle plates at positions not oppose to each other, a part of a plurality of pairs of the longitudinal roulette edges 20 and the edge receptacle plates 23 may be placed in opposition to each other to permit a selection of number of the longitudinal perforations 8 to be formed.

Figure 4:
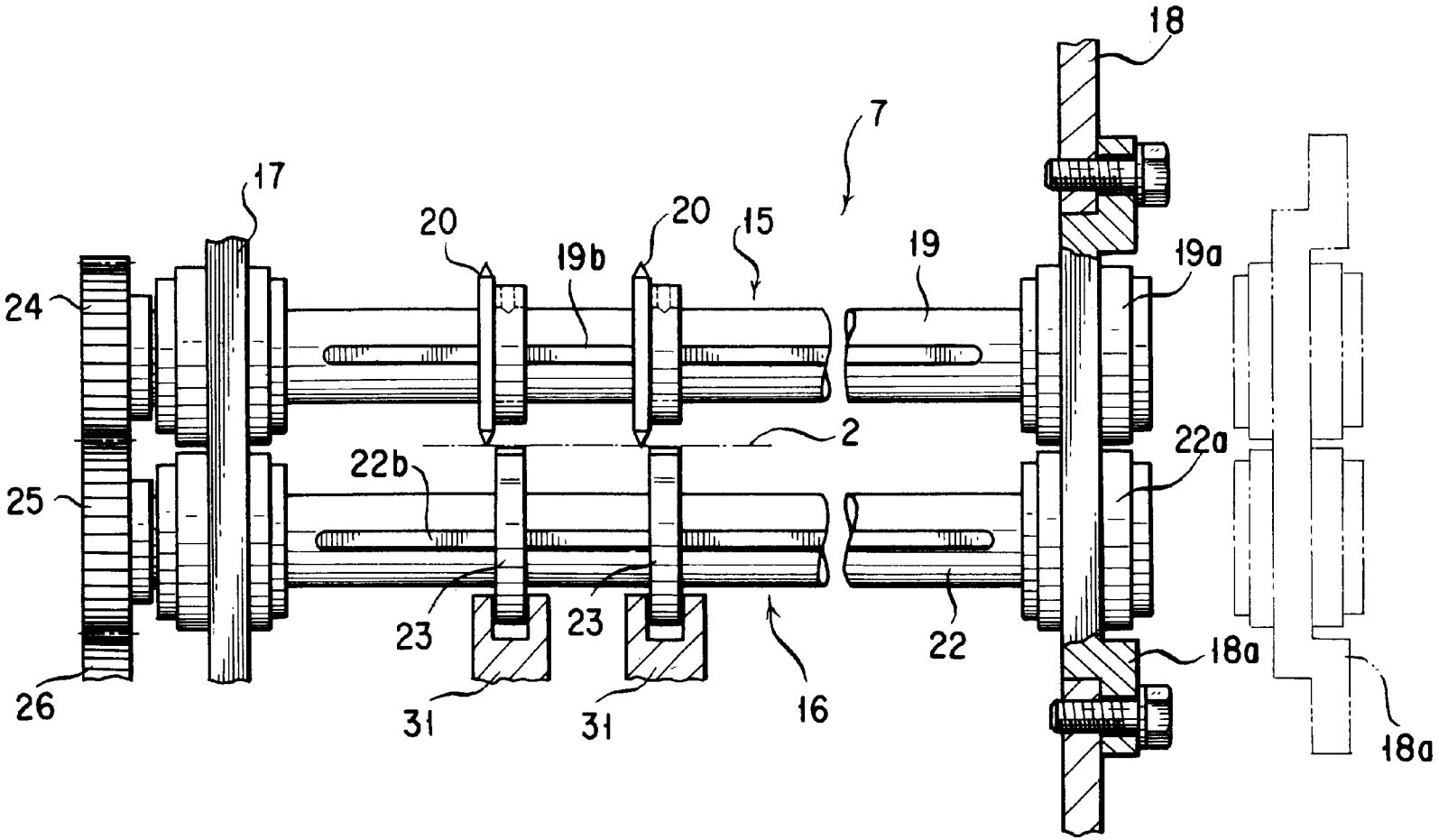
FIG. 4 is an explanatory illustration showing another example of the arbitrarily positioned longitudinal perforation forming apparatus.

On the other hand, in the arbitrarily positioned longitudinal perforation forming apparatus 7, as shown in FIG. 4, respective one bearings 19*a* and 22*a* of the first and second rotary shafts 19 and 22 may be supported by means of a mounting plate 18*a* which is detachable to one frame 18. By removing the mounting plate 18*a* from the frame 18, the bearings 19*a* and 22*a* can be released from one end portions of the first and second rotary shafts 19 and 22.

By the construction set forth above, the longitudinal roulette edges 20 and the edge receptacle plates 23 can be exchanged and number of these can be increased and decreased with respect to the first and second rotary shafts 19 and 22.

Next, construction and function of the arbitrarily positioned lateral perforation forming apparatus 9 will be discussed with reference to FIGS. 6 to 8. In the drawings, the reference numerals 41 and 42 denote lateral roulette cylinder and receptacle cylinder across the traveling path of the continuous web paper 2, respectively.

The lateral roulette cylinder 41 is supported on the frames 17 and 18 on both sides. A lateral roulette edge 43 is fixed in a groove provided at the predetermined position of the outer peripheral portion of the lateral roulette cylinder 41 in a condition slightly projecting the edge from the peripheral surface.

The receptacle cylinder 42 is supported on the frames 17 and 18 on both sides. On a part of the outer peripheral portion of the receptacle cylinder 42, an edge receptacle portion 42*a* contacting with (or opposing to with a fine gap) the tip end of the lateral roulette edge 43 is provided in a projecting stepped form over a small angular range, e.g. 5 to 15° in the circumferential direction. When the lateral roulette edge 43 is placed in opposition to the edge receptacle portion 42*a*, the lateral perforation 10 is formed in the continuous web paper 2 located therebetween.

Each supported portion of respective cylinders 41 and 42 on one frame 17 is extended outwardly from the frame 17. On the shaft portions of the supported portions extended outwardly from the frame 17, driven gears 44 and 45 having equal number of gear teeth are fixed at mutually axially offset positions, respectively. On the other hand, on the shaft portion of the receptacle cylinder 42, an intermediate gear 46 meshing with the driven gear 44 of the lateral roulette cylinder 41 is rotatably supported, and the intermediate gear 46 has gear teeth of the number equal to that of the driven gear 44.

A differential shaft 47 is supported on the frames 17 and 18 and an auxiliary frame 48 in the vicinity of the receptacle cylinder 42. A first gear 49 meshing with the driven gear 45 of the receptacle cylinder 42 and a second gear 50 meshing with the intermediate gear 46 are supported on the differential shaft 47 via a differential mechanism 51. Then, to the second gear 50, an input gear 52 connected to a drive gear train G3 for formation of lateral perforation is meshed, and the driven gear train G3 is connected to a driving shaft S of the machine. To the differential shaft 47, a servo motor 53 is connected.

As the differential mechanism 51, the harmonic drive (tradename) may be employed, for example. The first and second gears 49 and 50 rotate integratedly in obedience to the rotation of the input gear 52. During rotation, by rotation of the differential shaft 47, rotation phases of the first and second gears 49 and 50 are shifted relative to each other to cause shifting of rotational phases of respective driven gears 44 and 45 of the lateral roulette cylinder 41 and the receptacle cylinder 42 relative to each other.

The harmonic drive used in the differential mechanism 51 is HDUD Type 2F. The construction of the harmonic drive as the differential mechanism is shown in FIG. 7. In FIG. 7, the reference numeral 54 denotes a web generator, 55 denotes a flex spline, 56 denotes a circular spline, 57 denotes a dynamic spline, 58 denotes a web generator bearing, 59*a* and 59*b* denote flanges, 60 denotes a ball bearing. On the web generator 54, an actuation shaft 47 is fixed. On one flange 59*a*, the first gear 49 is fixed. On the other flange 59*b*, the second gear 50 is fixed.

Figure 8A:
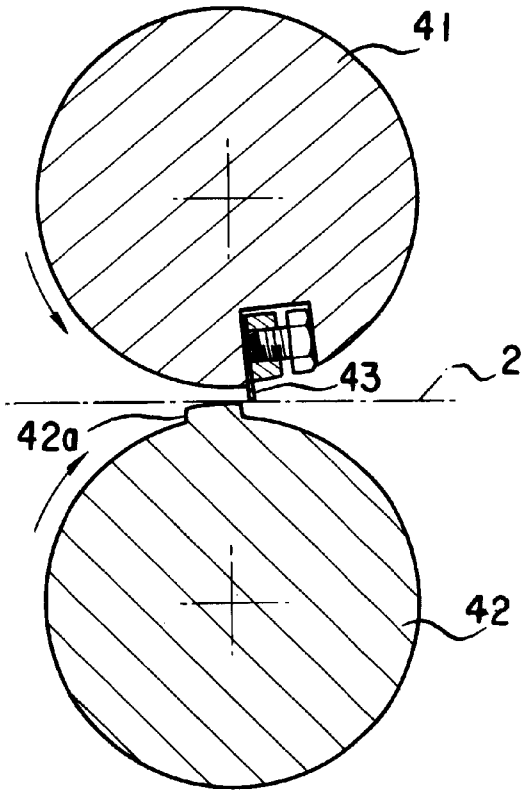
FIG. 8A is a section taken along line VIIIA—VIIIA of FIG. 6.

In the arbitrarily positioned lateral perforation forming apparatus 9, respective driven gears 44 and 45 are driven to rotate by rotation of the input gear 52 via both gears 50 and 49 of the differential mechanism 51, respectively. Then, the lateral roulette cylinder 41 and the receptacle cylinder 42 are driven to rotate at the same speed as the feeding speed of the continuous web paper 2 in the feed direction of the continuous web paper 2. The rotational phase of the receptacle cylinder 42 relative to that of the lateral roulette cylinder 41 is varied by the differential mechanism 51. The edge receptacle portion 42*a* is normally placed away from the lateral roulette edge 43 of the lateral roulette cylinder 41 as shown in FIG. 8A.

Figure 8B:
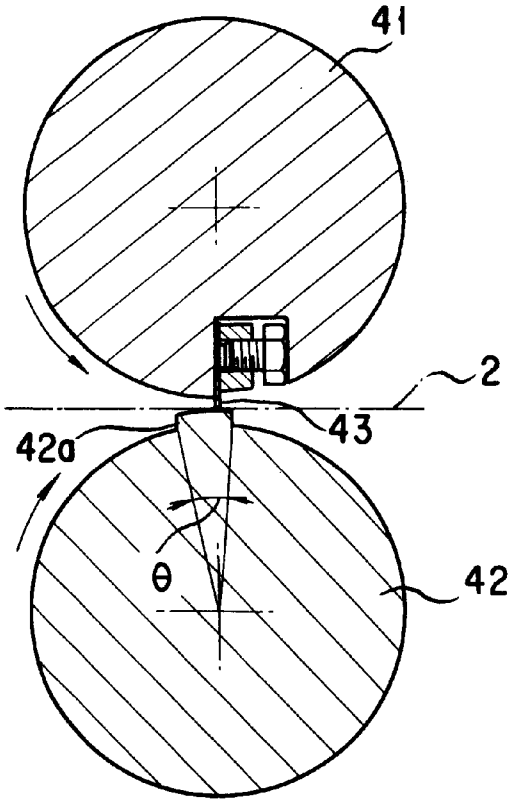
FIG. 8B is a section showing a condition where an edge receptacle portion of the receptacle cylinder is matched to a roulette edge of the lateral roulette cylinder.

In this condition, when the servo motor 53 is driven to rotate, the rotational phase of the first gear 49 is shifted relative to that of the second gear 50. When a direction to cause phase shift is selected so that the rotational phase of the receptacle cylinder 42 is advanced relative to that of the lateral roulette cylinder 41, for example, the edge receptacle portion 42*a* of the receptacle cylinder 42 is placed in opposition to the lateral roulette edge 43, as shown in FIG. 8B. By this, the lateral perforation 10 is formed in the continuous web paper 2. By actuating the differential mechanism 51 in reverse direction, the edge receptacle portion 42*a* is again moved away from the lateral roulette edge 43 so that the lateral perforation is not formed thereafter.

The servo motor 32 of the arbitrarily positioned longitudinal perforation forming apparatus 7 and the servo motor 53 used in the arbitrarily positioned lateral perforation forming apparatus 9 are controlled of their rotation speed, number of rotation and direction of rotation by the control unit. Then, the mark 12 printed on the continuous web paper 2 is read by the mark sensor 11. When the signal from the mark sensor 11 is input to the control unit, the servo motors 32 and 53 are driven in predetermined rotating directions at predetermined rotation speeds for predetermined number of turns after expiration of a predetermined period.

The receptacle cylinder 5 of the lateral perforation forming apparatus 1 for fold line, the input gear 26 of the arbitrarily positioned longitudinal perforation forming apparatus 7 and the input gear 52 of the arbitrarily positioned lateral perforation forming apparatus 9 are connected to the drive shaft S of the machine via respective drive gear trains (drive system) G1, G2 and G3, to be driven in synchronism with traveling speed of the continuous web paper 2, normally.

Figure 6:
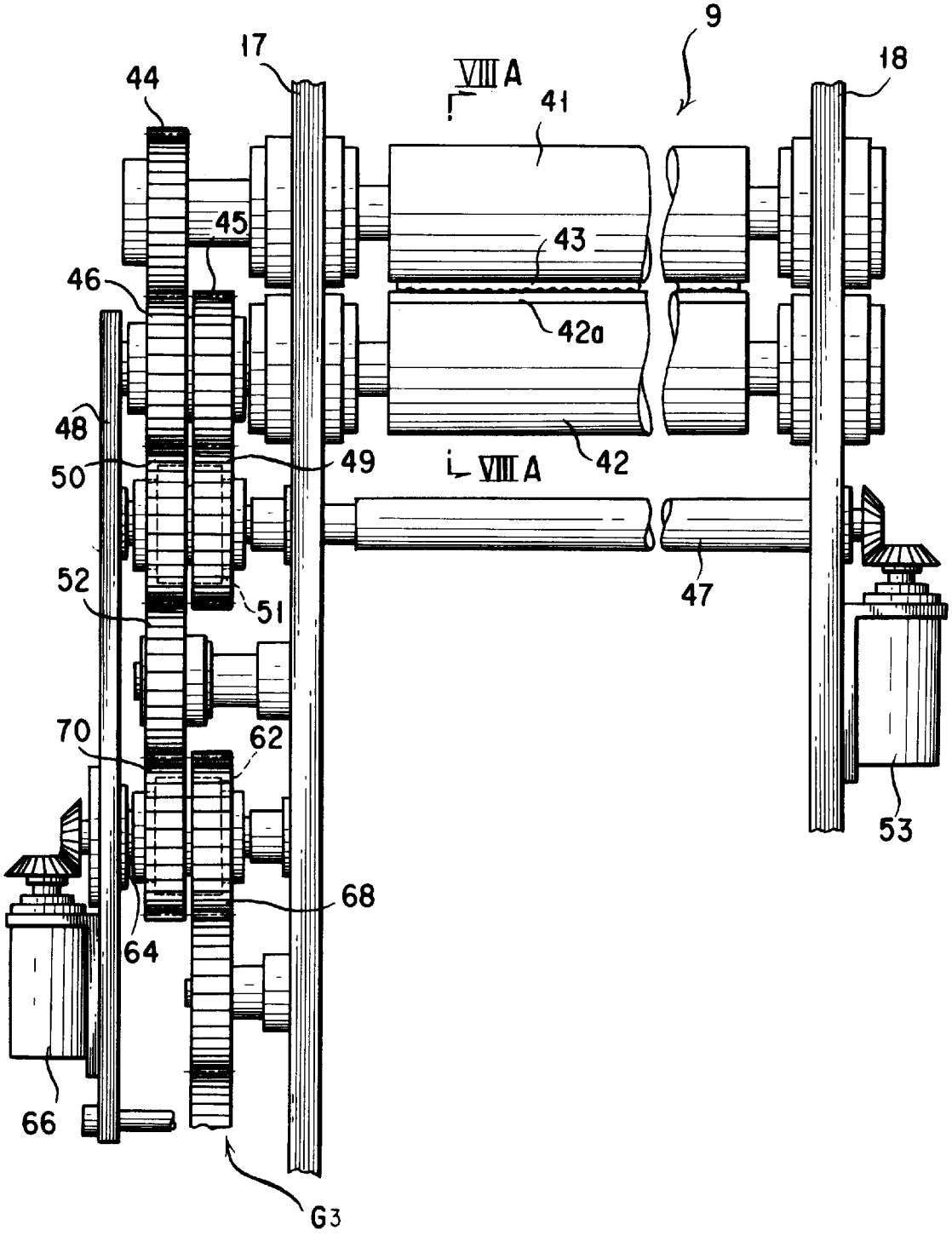
FIG. 6 is an explanatory illustration showing a construction of the shown embodiment of the arbitrarily positioned lateral perforation forming apparatus in the perforation forming section.
Figure 7:
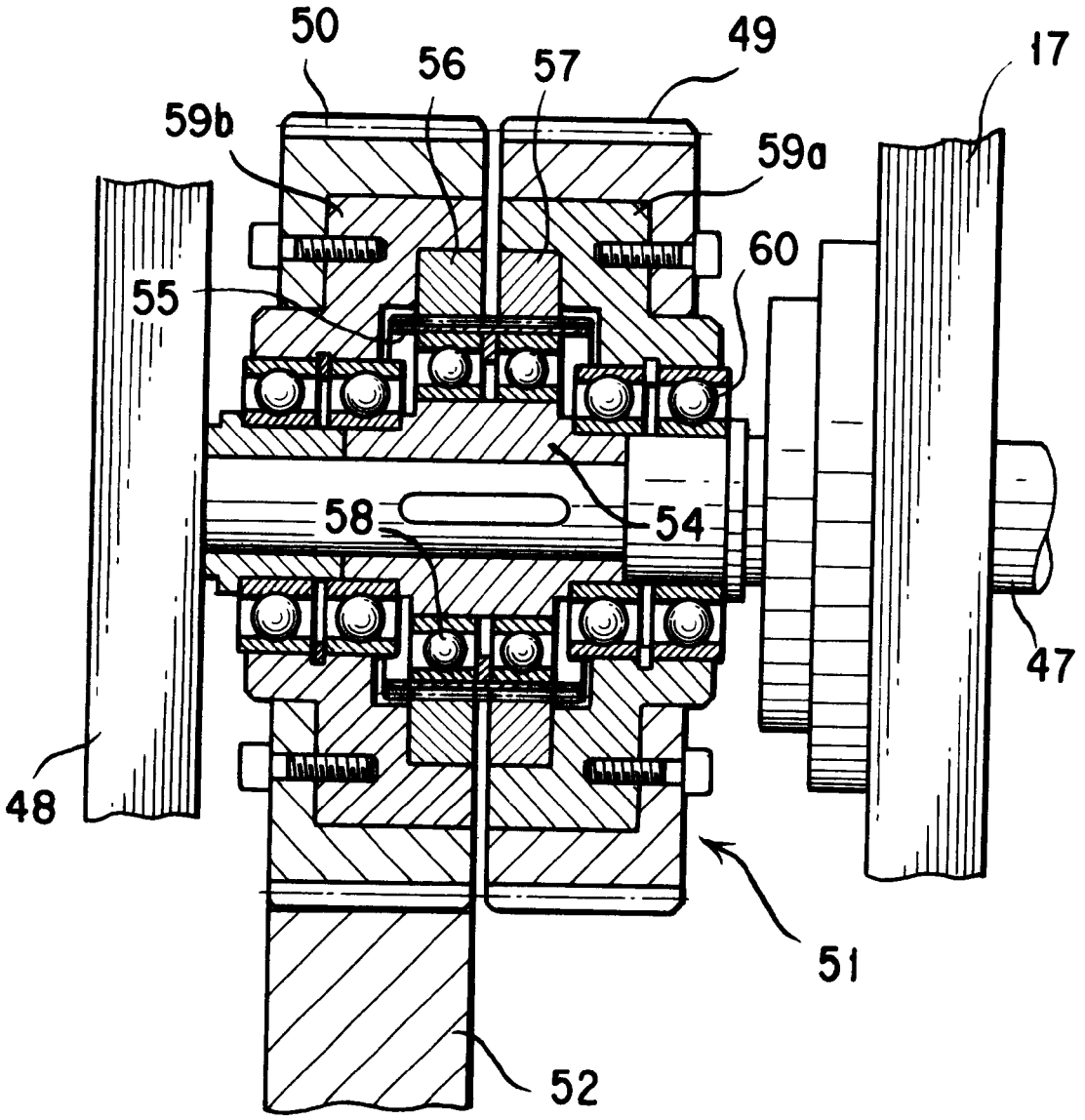
FIG. 7 is a section showing one example of a differential mechanism in the shown embodiment.

In both drive gear trains G2 and G3 for longitudinal perforation and lateral perforation, differential mechanisms 61 and 62 of the identical construction are interposed as shown in FIGS. 3 and 6. The differential mechanisms 61 and 62 have the same constructions as the differential mechanism 51 in the arbitrarily positioned lateral perforation forming apparatus 9. Respective differential shafts 63 and 64 are respectively driven to rotate by servo motors 65 and 66 to cause variations of rotational phases of gears 69 and 70 on output side relative to gears 67 and 68 on input side to cause shiftings of rotational phases of respective pair of longitudinal roulette cylinder 15 of the arbitrarily positioned longitudinal perforation forming apparatus 7 and the receptacle cylinder 16, and the lateral roulette cylinder 41 of the arbitrarily positioned lateral perforation forming apparatus 9 and the receptacle cylinder 42, relative to the rotational phase according to the drive shaft S of the machine. Thus, position a of the longitudinal perforation 8 and the lateral perforation 10 in the longitudinal direction (traveling direction of the continuous web paper) is varied relative to the lateral perforation for fold line. In the shown embodiment, the gear 69 and the input gear 26 of the longitudinal perforation apparatus 7 are used in common. Speed, number and direction of rotation of servo motors 65 and 66 of the differential mechanism 61 and 62 interposed in respective gear trains G2 and G3 are adjusted manually.

Overall operation of the shown embodiment will be discussed hereinafter.

Figure 9:
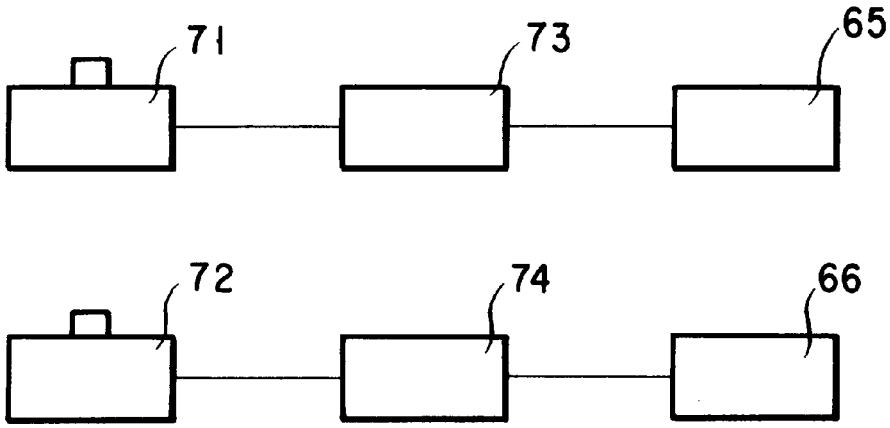
FIG. 9 is a block diagram showing one part of the control system in the shown embodiment.

At first, the differential mechanisms 61 and 62 of the drive gear trains G2 and G3 respective of the arbitrarily positioned longitudinal perforation forming apparatus 7 and the arbitrarily positioned lateral perforation forming apparatus 9 are driven via push buttons 71 and 72, drives 73 and 74 and their servo motors 65 and 66 as shown in FIG. 9 to manually adjust their rotation for setting a selected position a of the longitudinal perforation 8 and the lateral perforation 10 relative to the lateral perforation 3 for fold line.

The continuous web paper 2 is fed to travel in this condition. The continuous web paper 2 is formed with the lateral perforations for fold lines at a given interval by the lateral perforation forming apparatus 1 for fold line. Then, in the continuous web paper 2, in sheet portions defined by the lateral perforations for fold line, at the most upstream side portion of the sheet portion in which the longitudinal perforation 8 and the lateral perforation 10 are to be formed, the mark 12 is printed preliminarily.

Figure 10:
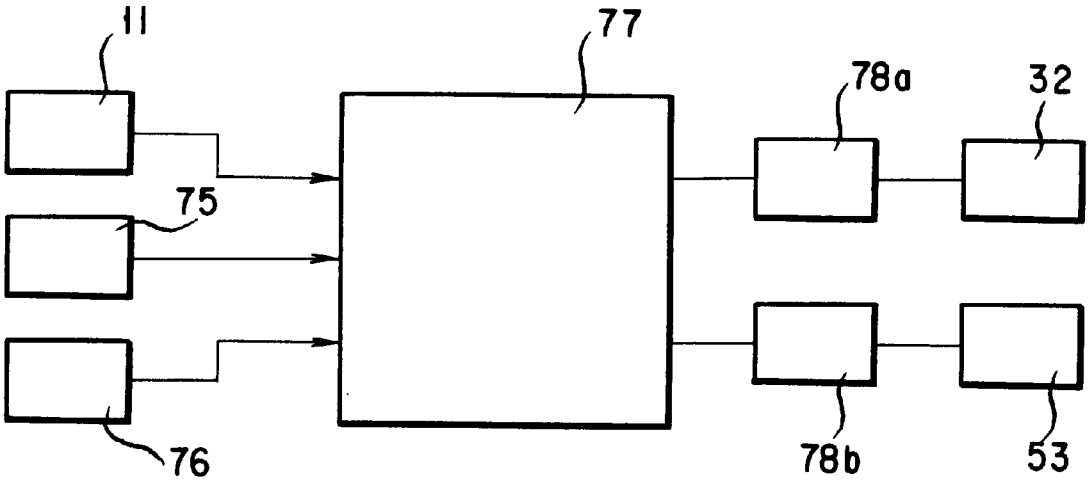
FIG. 10 is a block diagram showing another part of the control system in the shown embodiment.

Then, when the mark 12 is read by the mark sensor 11, measurement of traveling distance of the continuous web paper 2 according to signals from an encoder 75 mounted on the drive system of the machine is initiated by the control system shown in FIG. 10. A traveling distance from the mark sensor 12 to respective of perforation forming apparatus 7 and 9 are preliminarily set by a distance setting device 76. Then, inputs from the encoder 75 and the distance setting device 76 are arithmetically processed by the control unit 77. When the value of the signal from the encoder 75 becomes a set value, the servo motors 32 and 53 are driven to rotate in predetermined directions at predetermined rotation speeds for predetermined number of turns via drivers 78*a* and 78*b*.

By rotating both servo motors 32 and 53, the longitudinal perforation 8 having a length b starting from a position of a distance a from the lateral perforation 3 for fold line of the sheet portion where the mark 12 is placed is formed by the arbitrarily positioned longitudinal perforation forming apparatus 7, as shown in FIG. 2.

Next, by the arbitrarily positioned lateral perforation forming apparatus 9, the lateral perforation 10 is formed at a position of distance a from the lateral perforation 3 for fold line.

After formation of the arbitrarily positioned perforations 8 and 10, respectively, the servo motors 32 and 53 are rotated respectively at the same rotation speed for the same number of turns in the reverse direction to cause phase shift of the edge receptacle portions relative to respective roulette edges so that perforations are not formed any more.

Thus, by detecting presence or absence of mark 12 per each sheet portion, both perforations are formed at respectively selected positions only for the sheet portion, on which the mark 12 is preliminarily printed.

It should be noted that the positions of respective perforations may be determined from the mark 12 instead of the lateral perforation 3 for fold line.

In the shown embodiment, the embodiment employing both of the arbitrarily positioned longitudinal perforation forming apparatus 7 and the arbitrarily positioned lateral perforation forming apparatus 9 has been illustrated, it is possible to employ only arbitrarily positioned lateral perforation forming apparatus 9 as required.

In the shown embodiment, by sequentially arranging the arbitrarily positioned longitudinal perforation forming apparatus 7 and the arbitrarily positioned lateral perforation forming apparatus 9 in the traveling direction of the continuous web paper 2, the perforation in the longitudinal direction and the perforation in the lateral direction can be provided at selected positions in addition to the perforation for fold line, in the continuous web paper 2. For example, it is possible to form a portion surrounded by perforations. Therefore, wide variation can be provided for specifications of processing of printing products.

Although the present invention has been illustrated and described with respect to exemplary embodiment which is to be applied for the form printing machine or applicable for forming lateral perforation, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An apparatus comprising:

a lateral roulette cylinder having a peripheral surface and a lateral roulette edge projecting from said peripheral surface of said lateral roulette cylinder, said lateral roulette cylinder being arranged on a first side of a continuous web of paper and being rotatably mounted so as to be capable of rotating in a direction of travel of the continuous web of paper;

a receptacle cylinder having a peripheral surface and an edge receptacle portion projecting from said peripheral surface of said receptacle cylinder, said receptacle cylinder being arranged on a second side of the continuous web of paper such that said edge receptacle portion is capable of opposing said lateral roulette edge of said lateral roulette cylinder, said receptacle cylinder being rotatably mounted so as to be capable of rotating in a direction of travel of the continuous web of paper, whereby a lateral perforation is formed in the continuous web of paper when said edge receptacle portion opposes said lateral roulette edge of said lateral roulette cylinder;

a drive system for rotating said lateral roulette cylinder and said receptacle cylinder in synchronism with the travel of the continuous web of paper;

a first differential mechanism including a differential shaft, said first differential mechanism being arranged in said drive system and being linked to one of said lateral roulette cylinder and said receptacle cylinder for creating a difference between a rotational phase of said lateral roulette cylinder and a rotational phase of said receptacle cylinder by varying a rotation of said differential shaft, whereby said edge receptacle portion and said lateral roulette edge can be selectively positioned so as to oppose each other and so as to be offset from each other;

a first control unit for controlling the rotation of said differential shaft of said first differential mechanism;

a second differential mechanism including a differential shaft, said second differential mechanism being arranged in said drive system and being linked to said lateral roulette cylinder and said receptacle cylinder for making a rotation of said lateral roulette cylinder and said receptacle cylinder asychronous with the travel of the continuous web of paper by varying a rotation of said differential shaft of said second differential mechanism, whereby a lateral perforation position of the continuous web of paper can be varied; and a second control unit for controlling the rotation of said differential shaft of said second differential mechanism.

2. The apparatus of claim 1, further comprising a mark sensor for reading a mark pre-printed on the continuous web of paper so as to generate a mark read signal, and for sending said mark read signal to said first control unit, wherein said first control unit responds to said mark read signal by driving said first differential mechanism so as to form lateral perforations in the continuous web of paper.

3. The apparatus of claim 1, wherein said first differential mechanism is linked to said receptacle cylinder.

4. The apparatus of claim 3, wherein said drive system comprises a gear train including a plurality of gears, said first differential mechanism being disposed in one of said gears of said gear train.

5. The apparatus of claim 1, wherein said first differential mechanism is linked to said lateral roulette cylinder.

6. The apparatus of claim 5, wherein said drive system comprises a gear train including a plurality of gears, said first differential mechanism being disposed in one of said gears of said gear train.

* * * * *